US009694465B2

(12) United States Patent
Schneider et al.

(10) Patent No.: US 9,694,465 B2
(45) Date of Patent: Jul. 4, 2017

(54) METHOD AND DEVICE FOR BLOCKING EYEGLASS LENSES

(71) Applicant: Schneider GmbH & Co. KG, Fronhausen (DE)

(72) Inventors: Gunter Schneider, Marburg (DE); Ulf Börner, Marburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 412 days.

(21) Appl. No.: 14/360,039

(22) PCT Filed: Nov. 23, 2012

(86) PCT No.: PCT/EP2012/004849

§ 371 (c)(1),
(2) Date: May 22, 2014

(87) PCT Pub. No.: WO2013/075834

PCT Pub. Date: May 30, 2013

(65) Prior Publication Data

US 2014/0315472 A1 Oct. 23, 2014

(30) Foreign Application Priority Data

| | | |
|---|---|---|
| Nov. 23, 2011 | (DE) | 10 2011 119 157 |
| Apr. 4, 2012 | (DE) | 10 2012 006 739 |
| Apr. 18, 2012 | (DE) | 10 2012 103 385 |

(51) Int. Cl.
*B24B 13/005* (2006.01)
*B24B 47/22* (2006.01)

(52) U.S. Cl.
CPC ..... *B24B 13/005* (2013.01); *B24B 13/0055* (2013.01); *B24B 47/22* (2013.01); *B24B 47/225* (2013.01)

(58) Field of Classification Search
CPC .... B24B 13/005; B24B 47/22; B24B 13/0055
(Continued)

(56) References Cited

U.S. PATENT DOCUMENTS

| | | | |
|---|---|---|---|
| 2,660,011 | A | 11/1953 | Bernheim et al. |
| 3,417,454 | A | 12/1968 | Beasley |

(Continued)

FOREIGN PATENT DOCUMENTS

| | | | |
|---|---|---|---|
| DE | 25 45 948 | A1 | 4/1977 |
| DE | 29 31 723 | A1 | 2/1981 |

(Continued)

*Primary Examiner* — Robert Rose
(74) *Attorney, Agent, or Firm* — David S. Safran

(57) ABSTRACT

A blocking device and a method for blocking of eyeglass lenses on blocking pieces with a base body, with a blocking piece receiver which is located on the base body for the blocking piece which is to be attached to the eyeglass lens and with a positioning unit which is located on the base body for aligning and holding the eyeglass lens which is to be blocked, the blocking piece receiver and the positioning unit can be fixed on the eyeglass lens by activation being movable relative to one another via a lifting axis, the approach motion between the positioning unit and the blocking piece receiver being limited in the direction of the lifting axis by an adjustable stop means in at least two positions.

29 Claims, 11 Drawing Sheets

(58) Field of Classification Search
USPC ..... 451/42, 43, 5, 390, 460
See application file for complete search history.

(56) References Cited

U.S. PATENT DOCUMENTS

| | | | | |
|---|---|---|---|---|
| 4,319,846 | A * | 3/1982 | Henry | B29D 11/00932 356/127 |
| 5,070,657 | A | 12/1991 | Brule et al. | |
| 6,056,633 | A * | 5/2000 | Sesena | G01M 11/0221 451/384 |
| 7,150,672 | B2 * | 12/2006 | Mizuno | B24B 13/005 451/384 |
| 8,616,150 | B2 | 12/2013 | Savoie et al. | |
| 2011/0067628 | A1 * | 3/2011 | Savoie | B24B 13/005 118/500 |

FOREIGN PATENT DOCUMENTS

| | | | |
|---|---|---|---|
| DE | 690 05 249 | T2 | 4/1994 |
| DE | 10 2008 023 093 | A1 | 11/2009 |
| EP | 2 011 604 | A1 | 1/2009 |
| WO | 03/018254 | A2 | 3/2003 |

* cited by examiner

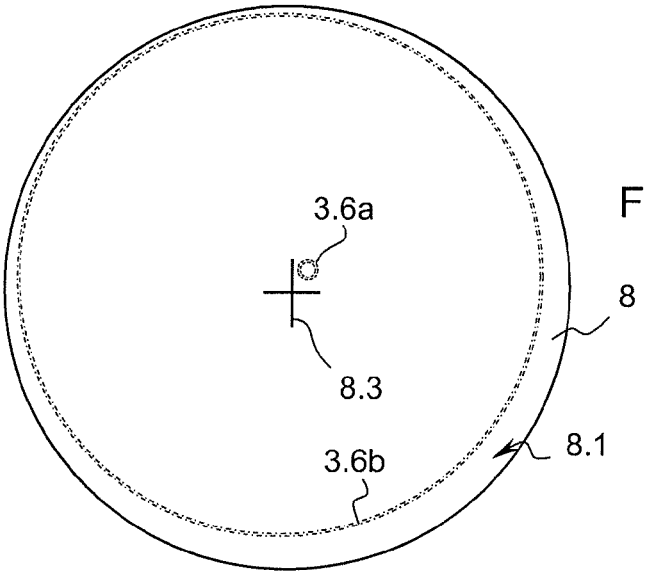
Fig. 11
Fig. 12
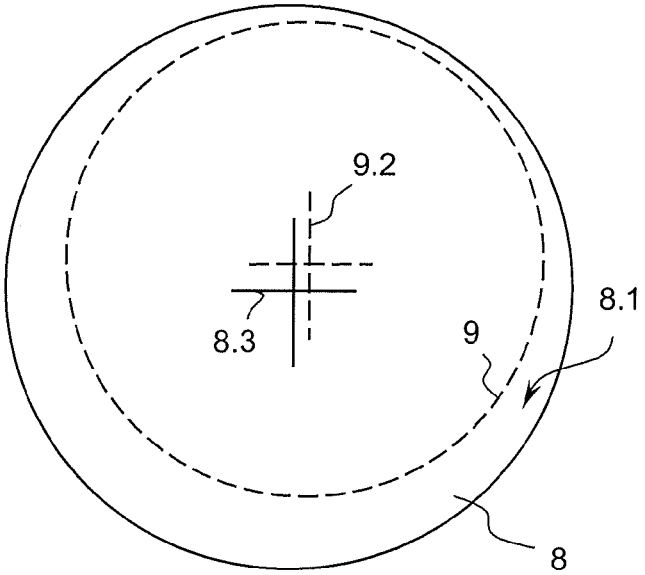

METHOD AND DEVICE FOR BLOCKING EYEGLASS LENSES

BACKGROUND OF THE INVENTION

Field of the Invention

This invention relates to a method for blocking of an eyeglass lens and to a blocking device for blocking of eyeglass lenses on blocking pieces having a blocking piece receiver which is located on a base body is to be attached to an eyeglass lens.

Description of Related Art

In general the term "eyeglass lens" in accordance with the invention is especially a plastic lens for eyeglasses.

The invention relates especially to a blocking device for blocking of eyeglass lenses or semi-finished eyeglass lenses on blocking pieces with a base body, with a blocking piece receiver which is located on the base body of the blocking piece which is to be attached to the eyeglass lens, and with a positioning unit which is located on the blocking device for alignment and holding of the eyeglass lens which is to be blocked, the blocking piece receiver and the positioning unit, which can be fixed on the eyeglass lens, being movable relative to one another along a lifting axis.

Furthermore, the invention relates especially to a method for blocking of a holding side of an eyeglass lens onto a coupling side of a blocking piece by means of plastic adhesive, the blocking piece being held in a blocking piece receiver and the eyeglass lens being movable relative to the blocking piece along one lifting axis.

German Patent Application DE 10 2008 023 093 A1 and corresponding U.S. Pat. No. 8,616,150 B2 already disclose a blocking device for blocking of eyeglass lenses on blocking pieces. This blocking device has a blocking piece receiver and a transport unit for positioning of the eyeglass lens which is to be blocked. For purposes of alignment of the relative position between the blocking piece and the eyeglass lens, the transport unit can be moved in five position-controlled axes of space, one translational lifting axis, a translational transverse axis and three axes of rotation which are aligned at right angles to one another, the axes of rotation being one pivoting axis and two pivot axes which thus image all three possible space-axes of rotation. The two pivot axes are intended to ensure a three-dimensional tilting of the eyeglass lens relative to the blocking piece. The eyeglass lens is pressed against the blocking piece via the translational lifting axis, leaving a defined gap. The eyeglass lens which is mechanically aligned relative to the blocking piece via the positioning unit is placed on the adhesive and by pressing is positioned at least indirectly against the blocking piece.

An end stop of the translational lifting axis is not reached in doing so. It is simply a predetermined holding position of the translational lifting axis within the framework of position control.

U.S. Pat. No. 2,660,011 discloses a horizontal alignment of a lens blank on a table, the lens blank being raised vertically after alignment and after pivoting the table away being lowered onto a blocking piece which is located underneath with heated adhesive.

The prior art does not allow optimum positioning of an eyeglass lens on an assigned blocking piece, especially when the holding side of the eyeglass lens facing the blocking piece and the coupling side of the blocking piece facing the eyeglass lens are matched to one another or are made complementary to one another and tilting for the optimum alignment is required. Furthermore the prior art does not allow optimum blocking, especially if the blocking means or adhesive requires a certain minimum thickness or optimum thickness, as is especially the case for plastic adhesives.

SUMMARY OF THE INVENTION

The object of the invention is to devise or propose a method for blocking and a blocking device such that simplified use is ensured or enabled in spite of a comprehensive area of application and/or that optimum or optimized blocking of eyeglass lenses by means of an adhesive, preferably of plastic, on blocking pieces is enabled.

This object is achieved by a method and a blocking device as disclosed herein.

The relative position between the eyeglass lens and the blocking piece which is necessary for blocking is easily established by the prior or preferred placement of the holding side of the eyeglass lens on the adhesive-free coupling side of the blocking piece. The blocking piece preferably has a negative surface of the holding side of the eyeglass lens so that they can be brought into almost complete contact against one another when placed, therefore can substantiate complete alignment.

With the preferred fixing of the blocking piece receiver including the blocking piece held in it or the tilt position of the blocking piece or blocking piece receiver relative to the eyeglass lens or the position of the eyeglass lens transversely to the lifting axis and/or the fixing of the pivoting position of the eyeglass lens relative to the blocking piece or the blocking piece receiver and the fixing of the eyeglass lens on the positioning unit, this relative position between the eyeglass lens and blocking piece can be fixed so that the eyeglass lens can be raised off the blocking piece again via the positioning unit.

Raising of the eyeglass lens enables the application of adhesive, which is preferably applied to the blocking piece, but which alternatively or in addition can also be applied to the holding side of the eyeglass lens. By subsequently placing the eyeglass lens on the blocking piece which is provided with adhesive, especially using an end stop with an altered position, the eyeglass lens is fixed with a predetermined or a certain distance relative to the blocking piece. This takes place in the fixed relative position which was obtained beforehand, and as described, between the eyeglass lens and the blocking piece so that an expanded or defined and/or uniform film of adhesive is attained between the eyeglass lens and the blocking piece.

In particular, it can be advantageous if the coupling side of the blocking piece is provided with markings and if the eyeglass lens has eyeglass lens markings for positioning of the eyeglass lens, the blocking piece markings and the eyeglass lens markings being aligned relative to one another. The eyeglass lens markings and the markings of the coupling side of the blocking piece are preferably manually aligned.

In particular, it is provided that the approach motion between the positioning unit and the blocking piece receiver in the direction of the lifting axis is limited by at least one adjustable stop means in at least two positions. For the approach motion between the positioning unit and the blocking piece receiver, there is especially a mechanical end stop which can have two positions with reference to or in the direction of the lifting axis. This is implemented in particular by a stop means which can be moved into at least two positions or via two different stop means, of which at least one is movable. The two positions differ by their distance in the direction of the lifting axis. In one position, the distance a between the positioning unit and a blocking piece receiver is greater than in the other position. Proceeding from the position of the eyeglass lens lying against the blocking piece, in this way, the distance a, therefore a defined distance, relative to the blocking piece is achieved so that an adhesive layer with a thickness which corresponds to this distance can be implemented. Based on the greater or defined thickness of the adhesive layer, stresses which can arise when the adhesive layer cures are not transmitted unevenly to the eyeglass lens. In particular, as a result of the greater or more defined thickness of the adhesive layer, a more reliable or more defined block connection (connection of the eyeglass lens to the assigned blocking piece) can be achieved or ensured.

It can also be advantageous here if the stop means can be moved incrementally or steadily into several positions, the stop means being adjustable at least proportionally in the direction of the lifting axis or transversely to the direction of the lifting axis. Using different stages ensures simple actuation of the stop means.

This is also achieved when the stop means has at least one stop surface which forms an end stop E, the stop means being made as a stop plate which can be adjusted transversely to the direction of the lifting axis with several staggered stop surfaces or as a stop nut which can be adjusted in the direction of the lifting axis with a stop surface or as a stop ramp which can be adjusted transversely to the direction of the lifting axis with a centered stop surface. Thus, using one stop means the position of the end stop can be set differently. Different heights a or adhesive thicknesses between the eyeglass lens and the blocking piece can be implemented.

Furthermore, it can be advantageous if the positioning unit has a holding element which can be fixed on the eyeglass lens by activation, and alternately functionally separately from it, an alignment element which can be placed against the eyeglass lens, and preferably, the holding element can be used as the alignment element. This alignment element is used, first of all, to align the eyeglass lens, therefore the blocking piece which lies in the blocking piece receiver, for purposes of maintaining a defined and fixable position. However, the holding element which can be placed against the eyeglass lens can also be used to align the eyeglass lens. Finally, alignment of the eyeglass lens according to the positioning unit is achieved by moving the holding element or the alignment element against a reference surface of the eyeglass lens which is lying on the pivotable blocking piece. This position is maintained by fixing the positioning unit. When the eyeglass lens to be blocked is subsequently pressed against the blocking piece which is provided with adhesive, molding of the adhesive which is to be introduced between the eyeglass lens and the blocking piece, proceeding from a droplet-shaped or ball-shaped metering amount, is necessary. The contact force is transferred altogether by the positioning unit which is fixed on the eyeglass lens, a uniform thickness of the adhesive according to the distance a being ensured or achieved.

For the distance a, therefore for the adhesive layer, preferably the following values are possible: 0 to 3 mm, 0.1 to 2 mm, 0.1 to 1.5 mm, 0.1 to 1 mm, 0.3 to 1 mm, 0.3 to 0.7 mm, 0.4 to 0.7 mm, 0.5 to 0.7 mm, 0.6 mm.

Preferably, the distance a or the thickness of the adhesive layer is at least on average more than 0.3 mm, especially more than 0.4 mm, especially preferably more than 0.5 mm and quite especially preferably more than 0.6 mm.

Preferably, the distance a or the thickness of the adhesive layer is at least on average essentially 1 mm, especially +/−0.2 mm.

It can also be advantageous if the positioning unit and the holding element have a suction cup for holding or fixing the eyeglass lens, especially the suction cup having an inner side which can be pressurized with negative pressure. The suction cup is preferably made elastic so that when seated on the eyeglass lens of the eyeglass lens surface the suction cup can be adapted according to the surface of the eyeglass lens both locally and also according to the inclination of the surface altogether, at least in one partial region. This tilting motion also goes along with the elastic deformation of the suction bowl. In doing so, it can be advantageously provided that there is an illumination unit on the holding element and/or in the inner side of the suction cup. By means of the illumination unit, a light pattern can be imaged as a reference marking onto the lens which is to be blocked and which would be useful to the user in the alignment of the lens relative to the holding element. Concentric circles and/or lines as well as crosses would be possible as the shape of this light pattern; the eyeglass lens which is optionally provided with eyeglass lens markings can be aligned using these shapes.

For this invention, it can be especially important if the alignment element has two or three contact pins which act in the direction of the lifting axis and which are arranged circumferentially to the lifting axis and/or around the suction cup and/or which can also be placed proportionally against the eyeglass lens in the direction of the lifting axis. When using three contact pins, the contact of the contact element relative to the eyeglass lens or the eyeglass lens surface which is to be positioned is completely determined. In the case of the fixed holding element, thus, a further pivoting motion or tilting motion of the eyeglass lens relative to the contact element would no longer be possible. In the case of using two contact pins, at least the fixing of the tilting motion of the contact element around the pivot axis would be possible. Thus, one degree of freedom for the pivoting or tilting between the contact element and the eyeglass lens would remain, but this can be blocked.

It can be advantageous if the alignment element has an axis of translation which runs parallel to the lifting axis, there being a coupling by means of which the alignment element and holding element can be coupled, in the coupled state the movement of the alignment element along the lifting axis and the movement of the holding element along the axis of translation being synchronized or coupled, and in the uncoupled state the translational movement of the holding element can take place in the direction of the axis of translation regardless of the lifting motion of the alignment element in the direction of the lifting axis. Due to the independence of the holding element and the alignment element from one another, both the holding element and the alignment element can be moved into contact against the eyeglass lens which is to be blocked independently of one another, preferably the alignment element being moved in the direction of the axis of translation along which the two elements can be moved. The holding element and the alignment element can be moved relative to one another solely in the direction of the axis of translation.

After the respective placement or suction against the eyeglass lens, after coupling of the two elements via the coupling, relative motion between the two elements is no longer possible. In the coupled state, therefore, the positioning apparatus is moved altogether, i.e., the alignment element and the holding element, synchronously along the lifting axis. Here, first of all, it is a lifting motion with the eyeglass lens which is attached to the positioning apparatus and which after applying the adhesive is followed by a lowering motion by means of which the eyeglass lens is placed on the blocking piece.

Furthermore, it can be advantageous if the lifting axis and/or the coupling can be manually operated. The capacity to manually operate the lifting axis ensures altogether a simple structure. Only the lifting axis could be equipped with an automatic drive in order to have altogether a simple and a versatile blocking device.

Moreover, it can be advantageous if the blocking piece receiver has two pivot axes which are aligned at a right angle to one another and at a right angle to the lifting axis, can be freely pivoted manually around the two pivot axes and can be fixed in a desired position. The right angle to one another and relative to the lifting axis can also be understood such that only one direction component of the respective pivot axes can be right-angled. The pivot axes are free, inactive axes which are not subject to any drives or gearing at all. This ensures a very simple structure in spite of the use of these pivot axes. Because the pivot axes are at a right angle to one another, any necessary compensation movement of the eyeglass lens for purposes of coupling to the holding element is possible. The two pivot axes are implemented by a spherical cap which is supported by slide bodies or roller bodies and whose movement in the bearing bed can be blocked by using negative pressure. This spherical cap can be pivoted completely freely within its bearing plane and accordingly also has the two aforementioned tilting axes.

Other advantages and details of the invention are explained in the following detailed description in conjunction with the accompanying drawings.

BRIEF DESCRIPTION OF THE DRAWINGS

FIG. 11 is a schematic sectional plan view or schematic diagram relating to the alignment of the eyeglass lens using light patterns;

FIG. 12 is a schematic sectional plan view or schematic diagram relating to the alignment of the eyeglass lens by means of markings;

DETAILED DESCRIPTION OF THE INVENTION

The same reference numbers are used for the same or same type of parts and components, the same or corresponding properties arising even if a repeated description is omitted.

Figure 1:
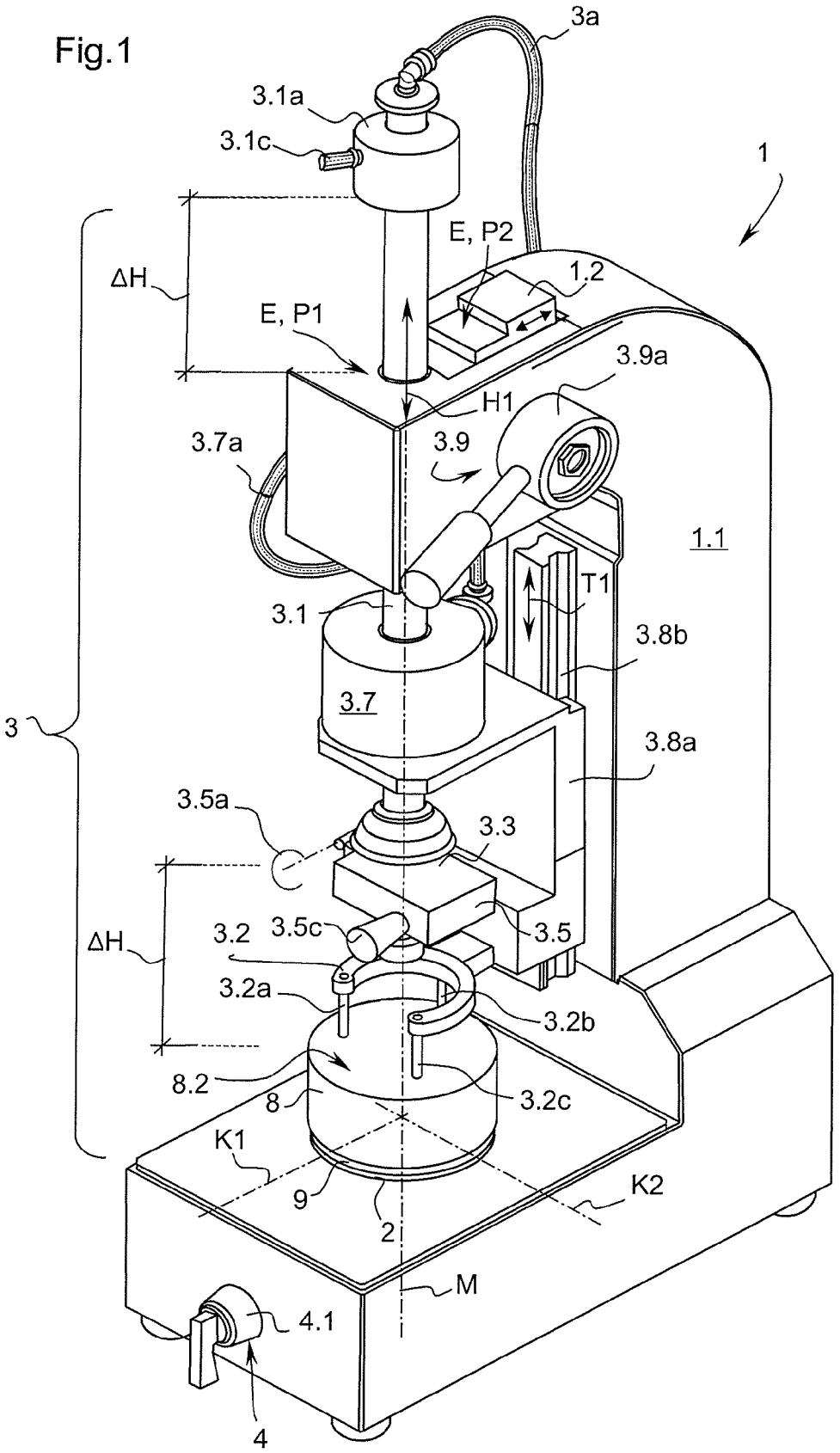
FIG. 1 is a perspective view of a blocking device in accordance with the invention.

FIG. 1 shows a blocking device 1 in accordance with the invention in a perspective view. The blocking device 1 preferably has a blocking piece receiver 2 for a blocking piece 9. The blocking piece 9 is used to receive and hold an eyeglass lens 8. The eyeglass lens 8 is especially an eyeglass lens made of plastic or a plastic lens. It is especially a lens blank. In the illustrated state the eyeglass lens 8 with its holding side 8.1 facing the blocking piece 9 rests on the blocking piece 9 or its coupling side 9.1. The reference side 8.2 which faces away from the blocking piece 9 or the still unmachined side or flat side 8.2 of the eyeglass lens 8 faces up in the illustrated example.

The blocking device 1 preferably has an especially C-shaped base body or machine body 1 on whose lower side the blocking piece receiver 2 is provided for a blocking piece 9 for an eyeglass lens 8. Preferably, the blocking piece receiver 2 can be tilted or pivoted around two pivot axes K1, K2. Via these pivot axes K1, K2, the blocking piece receiver 2, and thus, the blocking piece 9 can be pivoted relative to an eyeglass lens 8 which is to be located on it or can be moved and aligned in one tilting motion.

The blocking device 1 preferably has a positioning apparatus or unit 3. The positioning unit 3 is used especially for aligning and/or lifting or lowering of the eyeglass lens 8 which is to be located on the blocking piece 9. In particular, the eyeglass lens 8 can be linearly moved in the direction of a preferably vertically running lifting axis or axis of motion H1 by means of the positioning unit 3, especially preferably can be raised and lowered.

The positioning unit 3 preferably has a holding element 3.1 which is made especially as a rack, an assigned suction cup 3.3 and/or an assigned drive 3.9.

On the top end, there is the drive 3.9 for the holding element 3.1 which is made preferably as a pull-push rod with the suction cup 3.3 located preferably on the lower end. The holding element 3.1 with the suction cup 3.3 can be moved up and down in translation in the direction of the preferably vertical lifting axis H1 via the drive 3.9 which can preferably be manually operated.

Parallel to this lifting motion along the lifting axis H1, there is preferably a carriage 3.8*a* which is guided or can be displaced over a corresponding rail 3.8*b* on the base body 1.1 or the blocking device 1 in the direction of a parallel or vertical axis of translation T1. The positioning unit 3 or its carriage 3.8*a* has or bears preferably an alignment element 3.2 which can be placed against the eyeglass lens 8 or its reference side 8.2 especially via three contact pins 3.2*a*-3.2*c*. The alignment element 3.2 can preferably be coupled to the holding element 3.1 to be axially immovable via an especially radially acting coupling 3.7 so that this assembly which is preferably called the positioning unit 3 can be moved if necessary or alternatively jointly via the drive 3.9 in translation in the direction of the lifting axis H1 or the axis of translation T1 or vertically.

Preferably, the face side or coupling side 9.1 of the blocking piece 9 facing the eyeglass lens 8 which is to be blocked is matched to the preferably pre-shaped or already machined, especially preferably arched holding side 8.1 of the eyeglass lens 8, especially is preferably made at least essentially complementary to it. In particular, the matching of the blocking piece 9 or of the coupling side 9.1 takes place by corresponding selection of the blocking piece 9 from a plurality of different blocking pieces 9 or especially preferably by prior, in particular machining of the blocking piece 9 or the coupling side 9.1. Especially preferably, the blocking piece 9 is made of plastic and is accordingly very light, in particular it can be machined in the desired manner in a machine tool which is not shown for machining of eyeglass lenses.

Preferably, the eyeglass lens 8 is first placed directly—therefore without an adhesive—on the blocking piece 8 prior to the actual blocking with the blocking piece 9 so that the holding side 8.1 (optionally with a protective layer or cover film) lies directly on the coupling side 9.1.

After placement, first of all, preferably an alignment of the eyeglass lens 8 takes place relative to the blocking piece 9. This alignment preferably comprises alignment by shifting crosswise, turning and/or tilting.

The alignment by crosswise shifting, therefore in the radial direction with respect to the lifting axis H1 or a center axis of the blocking piece 9 or in a plane parallel to the reference side 8.2 of the eyeglass lens 8, takes place preferably manually and/or by means of a corresponding light pattern 3.6 or markings 8.3 and 9.2, as is detailed below.

The alignment by turning, therefore fixing of a rotary position of the eyeglass lens 8 relative to the blocking piece 9 takes place preferably by means of a corresponding light pattern 3.6 or markings 8.3 and 9.2, as will be detailed below.

For alignment by tilting, the eyeglass lens 8, the blocking piece 9 or the latter in its tilt position are pivoted relative to one another, especially around at least one pivot axis K1, K2, in particular so that the preferably not yet machined or planar top or reference surface 8.2 of the eyeglass lens 8 assumes a desired alignment, especially preferably in the horizontal. The alignment takes place preferably by the positioning unit 3 or by the alignment unit 3.2.

Based on the pivot axes K1, K2, especially on the blocking piece receiver 2, or other especially free tilting capacity, it can be preferably optionally tilted with the eyeglass lens 8 which rests with its holding side 8.1 on the blocking piece 9 or its coupling side 9.1 according to FIG. 1*a*. Preferably, the eyeglass lens 8 can also be pivoted relative to the blocking piece 9. Thus, the reference side 8.2 can be aligned as desired by the alignment element 3.2 or by the contact pins 3.2*a*-3.2*c* or the suction cup 3.3.

Figure 2:
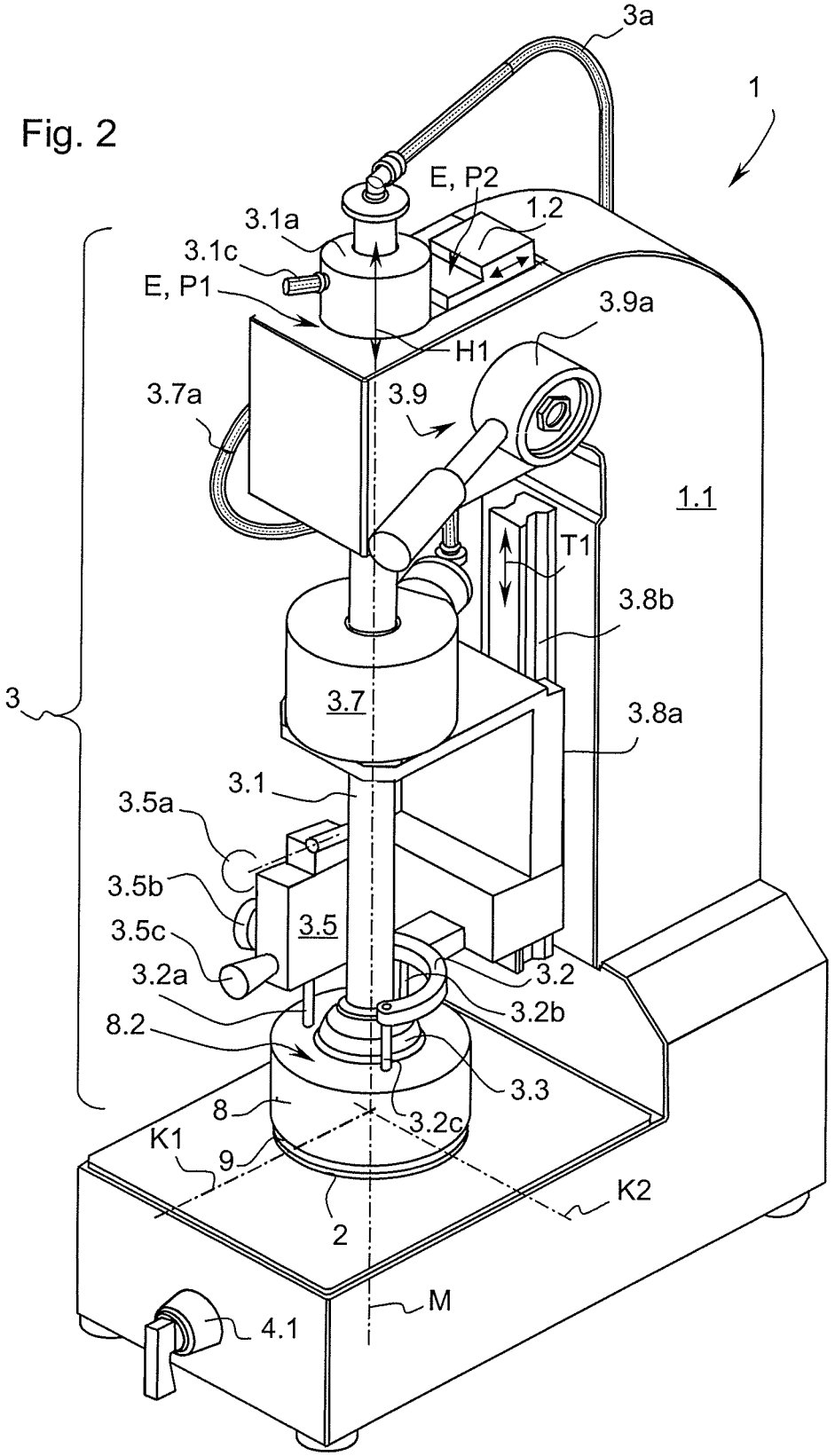
FIG. 2 is a perspective view of the blocking device with the camera folded away and the suction cup lowered.
Figure 3:
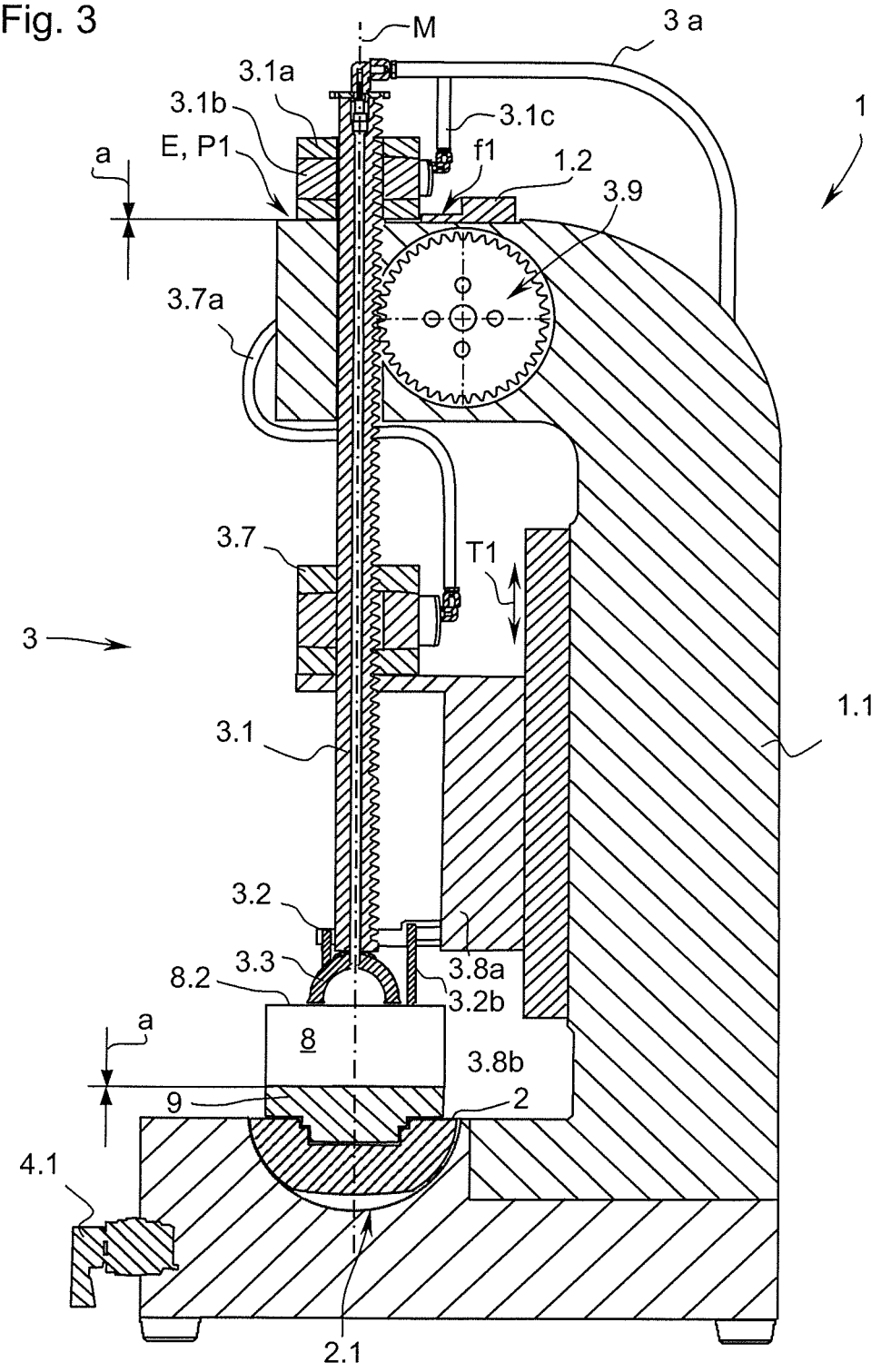
FIG. 3 is a schematic vertical sectional view of the blocking device according to FIG. 2.

Furthermore, before or afterwards, an alignment of the rotational position, therefore the pivoting position, of the eyeglass lens 8 relative to the blocking piece 9 takes place. To do this for example optics, an image recording unit or a camera 3.5 of the blocking device 1 or positioning unit 3 can be used, as is shown schematically in FIG. 1. In FIG. 1 the camera 3.5 is located in the axis of movement or lifting axis H1. FIG. 2 shows in a similar perspective arrangement the blocking device 1 with the camera 3.5 moved or pivoted out of the axis of movement H1. Here the positioning unit 3 or the holding element 3.1 or the suction cup 3.3 has already been lowered onto the eyeglass lens 8 or its reference side 8.1. FIG. 3 shows the blocking device 1 in a vertical section in this state.

The blocking piece receiver 2 can preferably be freely pivoted in a spherical cup 2.1. The two indicated pivot axes K1, K2 which are preferably aligned at right angles to one another are preferably only of a theoretical nature, since preferably a free pivoting capacity of the blocking piece receiver 2 in the spherical cup 2.1 is enabled in the illustrated example. But, other, for example, universal rocker bearing arrangements or axle arrangements are also possible.

In the aligned relative position, the suction cup 3.3 is attached or fixed on the surface 8.2 by means of negative pressure being applied between the eyeglass lens 8 and the positioning unit. Preferably, at the same time, the holding element 3.1 is coupled to the carriage 3.8*a* via the coupling 3.7, and thus, the alignment element 3.2 is fixed relative to the suction cup 3.3. By applying negative pressure, a contact force of the eyeglass lens 8 against the positioning unit 3 or the contact pins 3.2*a*-3.2*c* occurs so that a displacement of the eyeglass lens 8 relative to the positioning unit 3, i.e., relative to the suction cup 3.3 or relative to the alignment element 3.2, is no longer possible. To do this, a translational displacement movement of the suction cup 3.3 or of the alignment element 3.2 on the lens surface would be necessary; this is not possible due to the holding force of the suction cup 3.3.

The drive 3.9 preferably has a control lever 3.9*a* via which the holding element 3.1 which is made here as a rack can be easily moved in the direction of the lifting axis H1, as shown in FIG. 3.

With the coupling 3.7 released, the alignment element 3.2, preferably solely due to the force of gravity, especially supported by the mass of the carriage 3.8*a* and the coupling 3.7 makes contact against the eyeglass lens 8 in the direction of the axis of translation T1 and ensures or supports a corresponding alignment and contact of the eyeglass lens 8 against the contact pins 3.2*a*-3.2*c*. With the coupling 3.7 opened, regardless of this contact motion in the direction of the axis of translation T1, the holding element 3.1 with the suction cup 3.3 is brought into contact against the eyeglass lens 8 in the direction of the lifting axis H1. In this lower position P1, preferably a stop ring 3.1*a* which is guided on the upper end of the rack 3.1 is coupled to the rack 3.1 via a coupling element 3.1*b*. Thus, preferably, an end stop E which is formed by the base body 1.1 as a stop means is defined with a first position P1.

Figure 4:
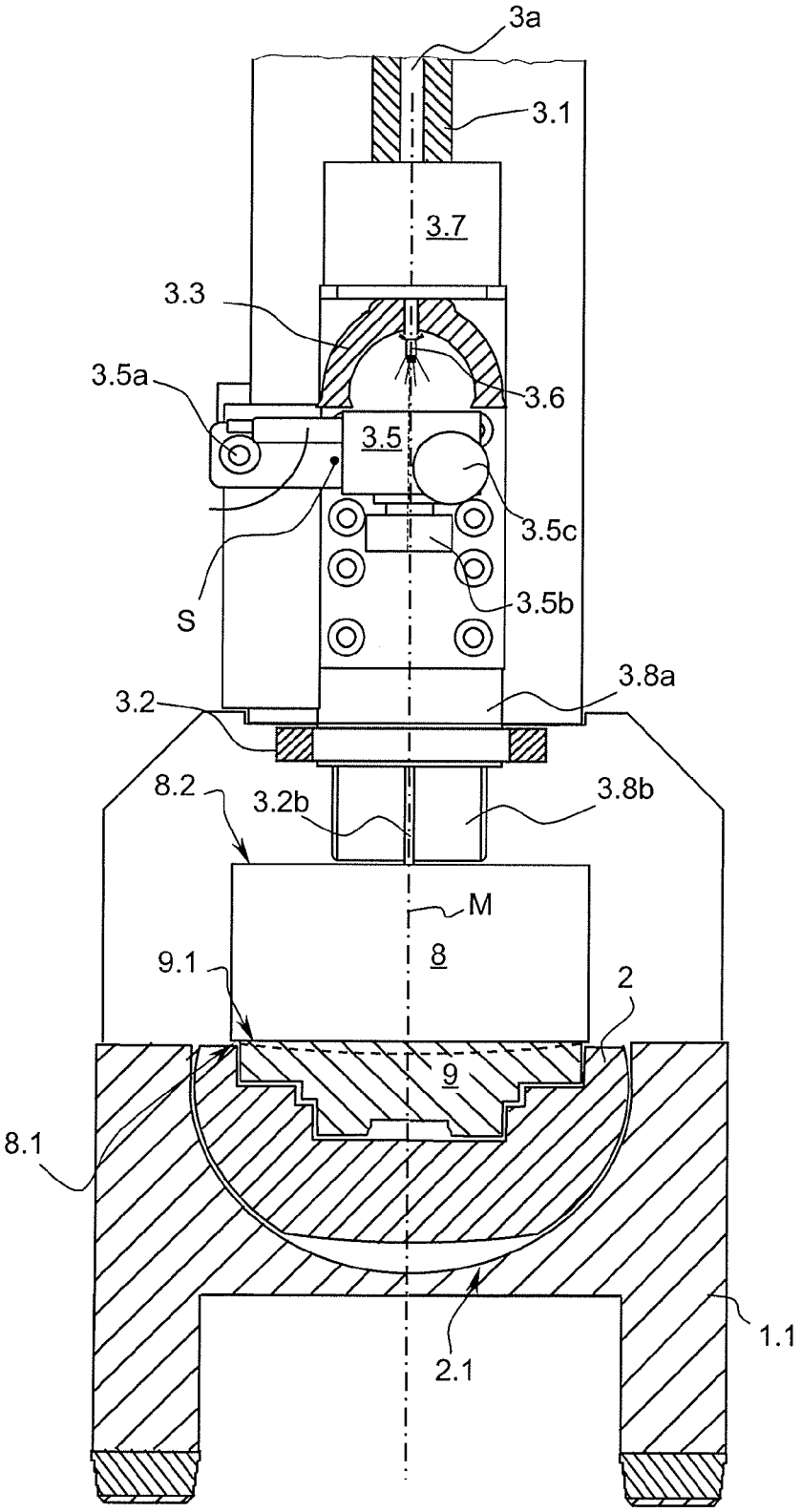
FIG. 4 is a schematic vertical sectional view of the blocking device according to FIG. 1 from the front.

To raise the contact pins 3.2*a*-3.2*c*, the holding element 3.1 with the suction cup 3.3 is preferably raised so far that the suction cup 3.3 makes contact against the carriage 3.8*a*, especially against a leg of the carriage 3.8*a* which guides the holding element 3.1, and guides the carriage upward at the same time. In this upper position of holding element 3.1, which has been moved up by a dimension ΔH as shown in FIG. 4, there is preferably a catch position of the drive 3.9 so that preferably activation or actuation of the drive 3.9 is necessary to travel down.

Figure 5:
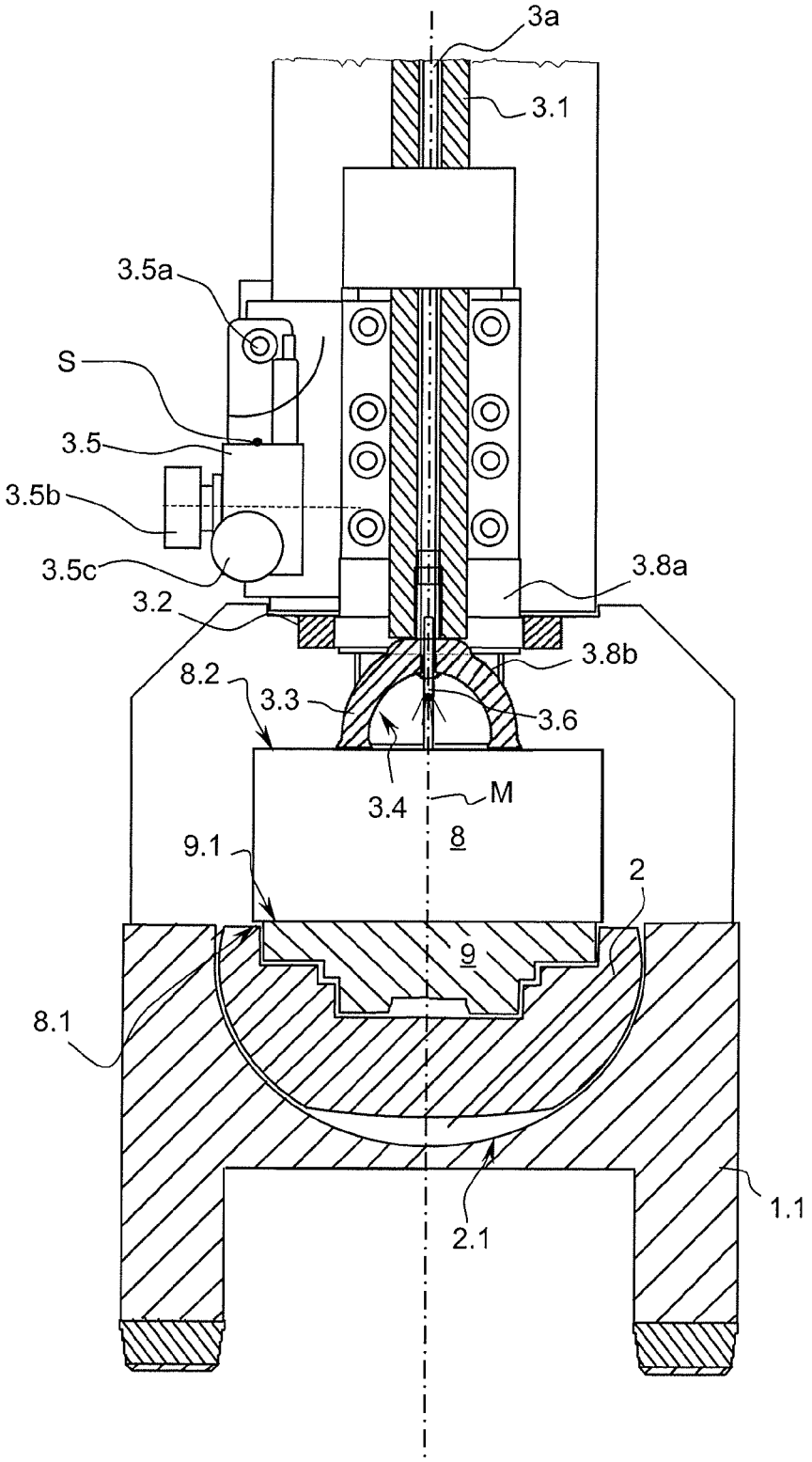
FIG. 5 is a schematic vertical sectional view of the blocking device according to FIG. 2 from the front.

After completed contact or resting with the preceding alignment of the eyeglass lens 8 on the blocking piece 9, the pivot axes K1, K2 are blocked or the blocking piece receiver 2 in spherical cup 2.1, as shown in FIG. 5, is blocked especially by means of or by applying negative pressure, preferably by actuation of a switch 4.1 (see, FIGS. 1 and 2). Thus, altogether the relative position between the eyeglass lens 8 with its reference side 8.2 on the one hand and the blocking piece 9 which rests on the blocking piece receiver 2 on the other is fixed, except for the lifting motion along the lifting axis H1.

After raising the eyeglass lens 8, an adhesive 10, especially of plastic, can be applied to the blocking piece 9 and/or the eyeglass lens 8.

The adhesive 10 is preferably applied in the hot state and/or is heated, especially to liquefy it and/or to make it adhesive.

After applying the adhesive 10, the eyeglass lens 8 is lowered again by means of the positioning unit 3, especially by actuating the drive 3.9. In particular, the eyeglass lens 8 is pressed against the preferably still warm or not yet set adhesive 10, and thus, against the coupling side 9.1 of the blocking piece 9. Especially preferably, the eyeglass lens 8 is caused to approach only the blocking piece 9 and especially a predetermined distance a is maintained, as is explained in detail below. However, alternatively, it is also possible to apply pressure with a predetermined and/or path-dependent force which decreases especially toward the eyeglass lens 8.

Figure 6:
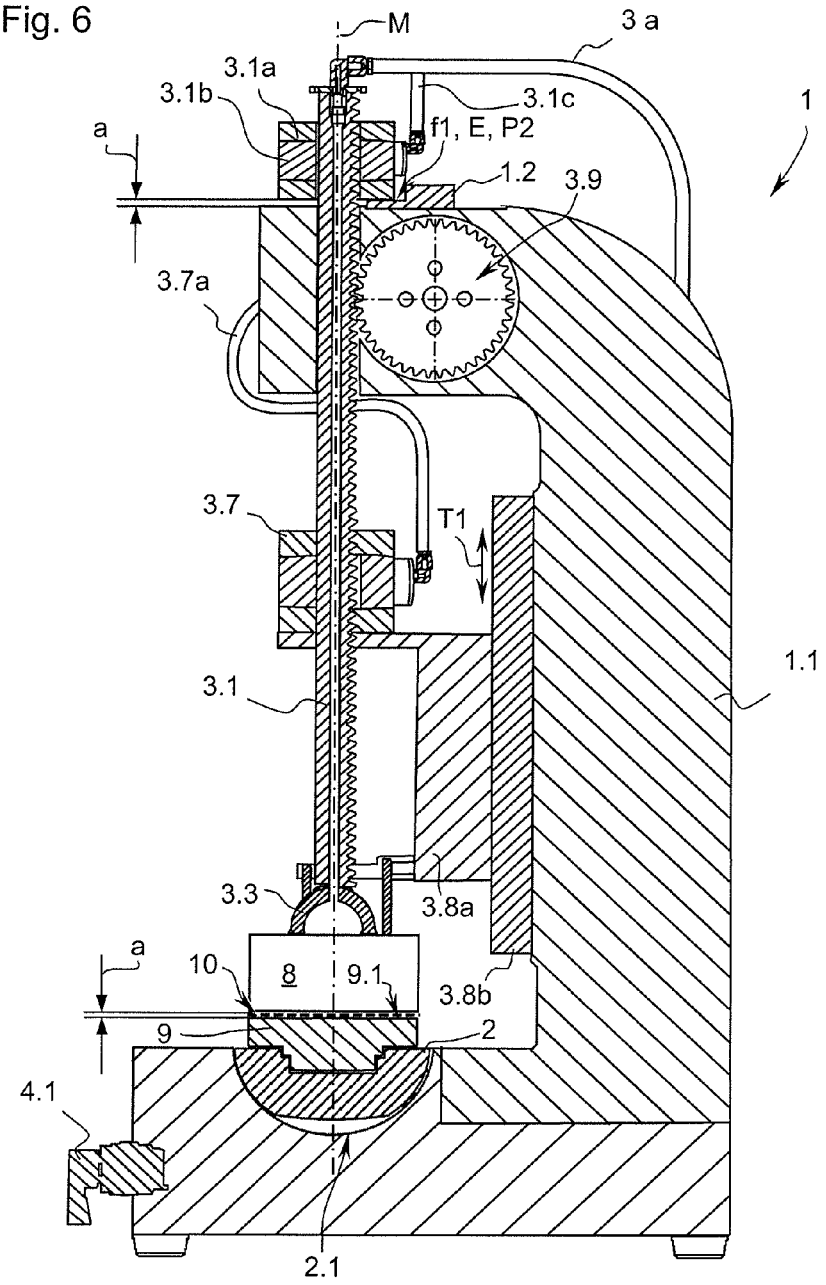
FIG. 6 is a schematic vertical sectional view of the blocking device with the eyeglass lens blocked.

To place the eyeglass lens 8 against the coupling side 9.1 of the blocking piece 9, which side is provided with the adhesive 10, as shown in FIG. 6, a stop means 1.2 is inserted or pushed in laterally according to the direction of the arrow preferably between a stop which is formed preferably by a stop ring 3.1*a* on the holding element 3.1, on the one hand, and the base body 1.1 or other thrust bearing, on the other. In this way, the end stop E is changed or a new or altered position P2 is formed so that according to the thickness a of the stop means 1.2, the predefined or desired distance a between the eyeglass lens 8 and the blocking piece 9 is ensured. Thus, the eyeglass lens 8 is positioned with the indicated distance a relative to the blocking piece 9 so that the adhesive 10 which is contained between the eyeglass lens 8 and the blocking piece 9 is present or spread in a corresponding thickness between the eyeglass lens 8 and the blocking piece 9.

According to FIGS. 2 and 3, the alignment element 3.2 and the suction cup 3.3 are placed against the eyeglass lens 8 preferably as described above and the suction cup 3.3 is fixed. On the top end of the rack 3.1, there is preferably the stop ring 3.1*a* which rests against the base body 1.1, therefore the end stop E, in position P1, and then, is preferably fixed by clamping onto the holding element 3.1, especially pneumatically or by negative pressure.

Figure 7:
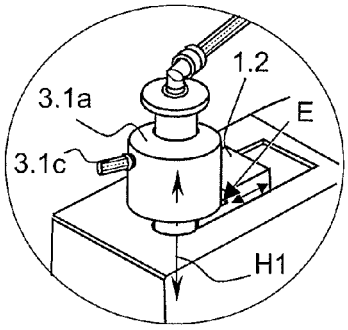
FIG. 7 is an enlarged extract from FIG. 2 in the upper region of the blocking device with an end stop.

After raising the eyeglass lens 8 for purposes of supplying adhesive to the blocking piece 9, the stop means 1.2, with height a as shown in FIGS. 6 & 7, is moved to the left in the direction of the arrow so that after subsequently depositing the eyeglass lens 8 again, for purposes of contact against the adhesive, the stop ring 3.1*a* makes contact against the stop means 1.2. The stop means 1.2 forms the new end stop E in position P2 so that the eyeglass lens 8 is now positioned with a distance a that is preferably from roughly 0.5 mm to 1.5 mm (here shown enlarged) above the blocking piece 9. However, the height of the stop means 1.2 can be chosen at will.

The activation or movement of the stop means 1.2 takes place preferably with a time delay so that the new end stop E is only present when the operator has moved the positioning unit 3 up for purposes of feeding adhesive 10. With simultaneous activation, therefore together with the coupling 3.7 and the suction cup 3.3, the stop means 1.2 would be located laterally against the stop ring 3.1*a* with pretensioning; but this would also be fundamentally possible.

Figure 8:
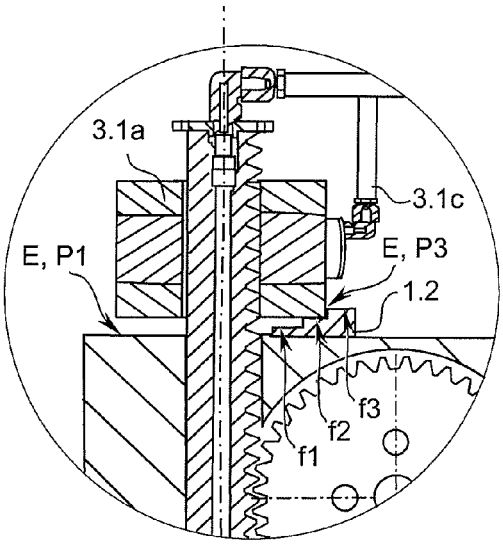
FIG. 8 is a schematic sectional view of the end stop.
Figure 9:
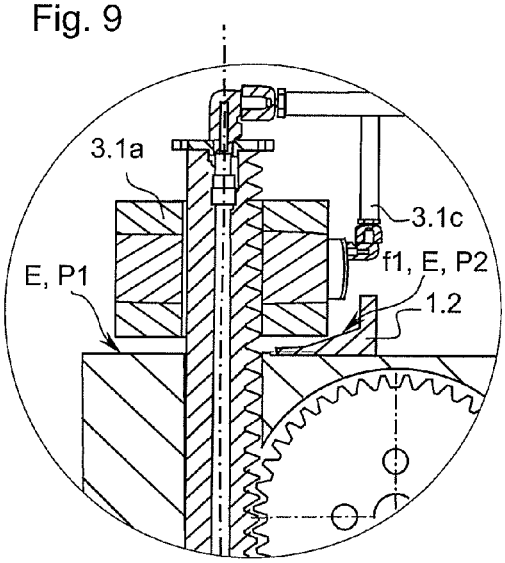
FIG. 9 is a schematic sectional view of the end stop according to another version.

The stop means 1.2 can also be made according to FIG. 8 as a stop plate with different stop surfaces f1, f2, f3. FIG. 8 shows the end stop E in another position P3. Alternatively, a wedge-shaped stop part according to FIG. 9 is also possible, and in this case the lateral positioning must be done much more precisely.

Figure 10:
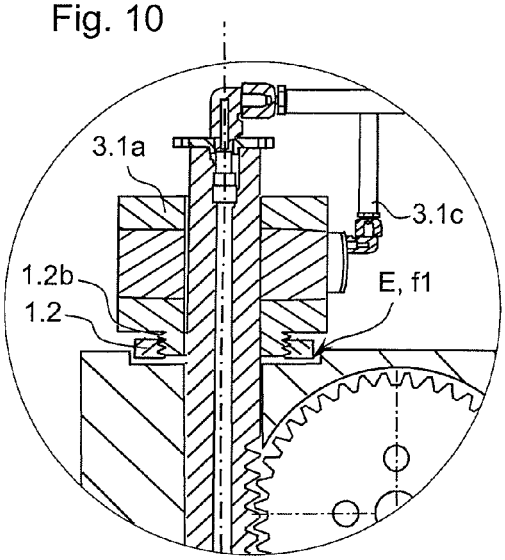
FIG. 10 is a schematic sectional view of the end stop according to a further version.

The stop means 1.2 can also be made according to FIG. 10 as a stop nut which can be adjusted steadily via a thread 1.2*b* relative to the stop ring 3.1*a* in the direction of the lifting axis H1.

The positioning unit 3 or the holding element 3.1 is therefore preferably lowered only until the altered end stop E or the altered new position P2 is reached. After reaching this altered (higher in the illustrated example) end position P2, further actuation of the drive 3.9 is no longer possible and/or further lowering of the eyeglass lens 8 onto the blocking piece 9 is no longer possible. Accordingly, the predetermined or desired distance a between the blocking piece 9 and the eyeglass lens 8 is maintained. This distance a therefore dictates the thickness of the adhesive layer.

It is noted that, in place of the change of the position P1 of the end stop E, which was described only rudimentarily using FIG. 6, to the position P2 by pushing the stop means 1.2 in between, other designs are also possible. In particular, some other mechanical adjustment or change of the end stop E, but alternatively, optionally also for example, a change of a setpoint is possible during control or adjustment.

For purposes of applying negative pressure to the inner side 3.4 of the suction cup 3.3, there is preferably a pressure line 3*a* which can be supplied accordingly with negative pressure. The same applies preferably to the coupling 3.7 and a coupling element 3.1*b* of the stop ring 3.1*a* which have a negative pressure supply 3.7*a*, 3.1*c*. The suction cup 3.3 and the couplings 3.7, 3.1*b* are then preferably exposed to negative pressure at the same time.

The coupling 3.7 and the coupling element 3.1*b* (coupling of the stop ring 3.1*a*) can also be actuated or triggered independently of one another and/or independently of the suction cup 3.3.

According to FIGS. 4 & 5, the blocking piece receiver 2 preferably has a bearing 2.1 which is made as a spherical cap and via which it can be brought into the desired position. By applying negative pressure to the bearing 2.1 (especially controlled by the switch 4.1 or in some other way), the blocking piece receiver 2 is fixed in the bearing 2.1. In this or some other way, a locking means 4 for blocking or fixing the pivot axis (axes) K1, K2 can be implemented.

According to FIGS. 4 & 5, preferably within the suction cup 3.3, there is preferably an illumination unit 3.6. Via the illumination unit 3.6, a light pattern 3.6*a*, 3.6*b* can be produced (as indicated schematically in FIG. 11) for purposes of orientation or alignment of the eyeglass lens 8 relative to the positioning unit 3 or suction cup 3.3 and to facilitate positioning of the eyeglass lens 8 as a positioning aid.

According to FIG. 11, these light patterns can be made as a centric mid-point circle 3.6*a* or as a concentric peripheral circle 3.6*b*. On the eyeglass lens 8 or on its reference side 8.2, the location of the suction cup 3.3 or the desired position of the eyeglass lens 8 is shown so that the eyeglass lens 8 can be aligned accordingly relative to the blocking piece 9, especially by lateral displacement, turning and/or tilting.

According to FIG. 12 the eyeglass lens 8 preferably has one or more visible eyeglass lens markings 8.3 while the blocking piece 9 preferably has one or more corresponding markings 9.2 which can be optically brought into agreement by the user. This can be achieved without optical aids or also based on the picture obtained by the camera 3.5, as explained below. The latter is much more accurate since a preferably centric view of the indicated markings 8.3, 9.2 is possible via the camera 3.5.

According to FIGS. 1 and 2, the camera 3.5 can be moved into a roughly horizontal position (FIGS. 1, 4) out of a lateral, vertically aligned position (FIGS. 2, 5) via a pivoting axis 3.5*a*. In this horizontal position, an objective lens 3.5*b* of the camera 3.5 is aligned concentrically to the lifting axis H1 or a center axis M. In this position, the objective lens 3.5*b* is concentric to the eyeglass lens 8 so that the marking 8.3 according to FIG. 11 and/or FIG. 12 can be acquired in the centric viewing direction. The camera picture is displayed to the user via a monitor which is not shown so that he can align the eyeglass lens 8 as desired to the blocking piece 9.

To operate the camera 3.5, it preferably has a handle 3.5*c* by means of which the camera 3.5 can be moved into the indicated horizontal position. When the camera 3.5 is released, it swivels, preferably by itself, into the vertical lateral position as shown in FIG. 4, especially as a result of a center of gravity S which is located off-center to the pivoting axis 3.5*a*. In this position the positioning unit 3 or the suction cup 3.3 can be adjusted.

The aforementioned alignment aids 3.6*a*, 3.6*b*, 8.3, 9.2 can, of course, be used in any combination. The camera 3.5 viewed in this way is not strictly necessary. The same applies to the light patterns 3.6*a*, 3.6*b*. For example, the two markings 8.3, 9.2 which can be aligned with respect to one another would be sufficient by themselves. Alternatively, the sole use of the light patterns as shown in FIG. 12 would be sufficient if the centric placement of the eyeglass lens 8 alone were all that mattered.

Figure 13:
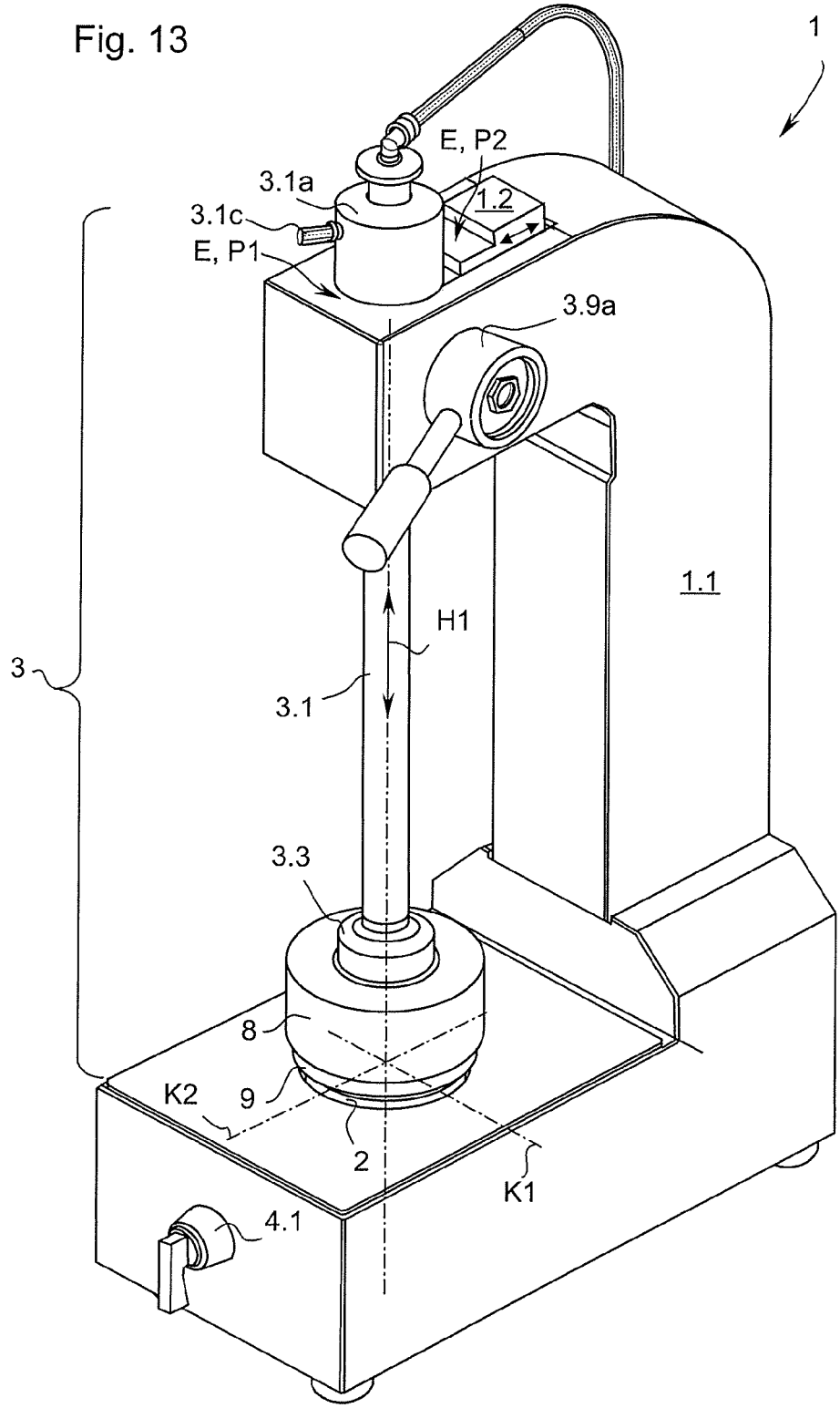
FIG. 13 is a perspective view of the blocking device according to another version.

FIG. 13 shows an alternative embodiment, the blocking device 1 or the positioning unit 3 not having a coupling 3.7 or an alignment unit 3.2. The blocking piece receiver 2 and the blocking piece 9 which rests preferably indirectly on it and the eyeglass lens 8 are aligned in position individually only by the suction cup 3.3, so that the suction cup 3.3 is then fixed on the eyeglass lens 8 after supplying negative pressure. Tracking of the positioning unit 3 due to the narrowing suction cup 3.3 which is contracting in the axial direction can possibly be necessary during fixing. After fixing of the two pivot axes K1, K2, especially via the locking means 4 or the switch 4.1, as in the above described embodiment, there remains thus only one free lifting motion in the direction of the lifting axis H1 which ensures application of adhesive 10 between the eyeglass lens 8 and the blocking piece 9.

Figure 14:
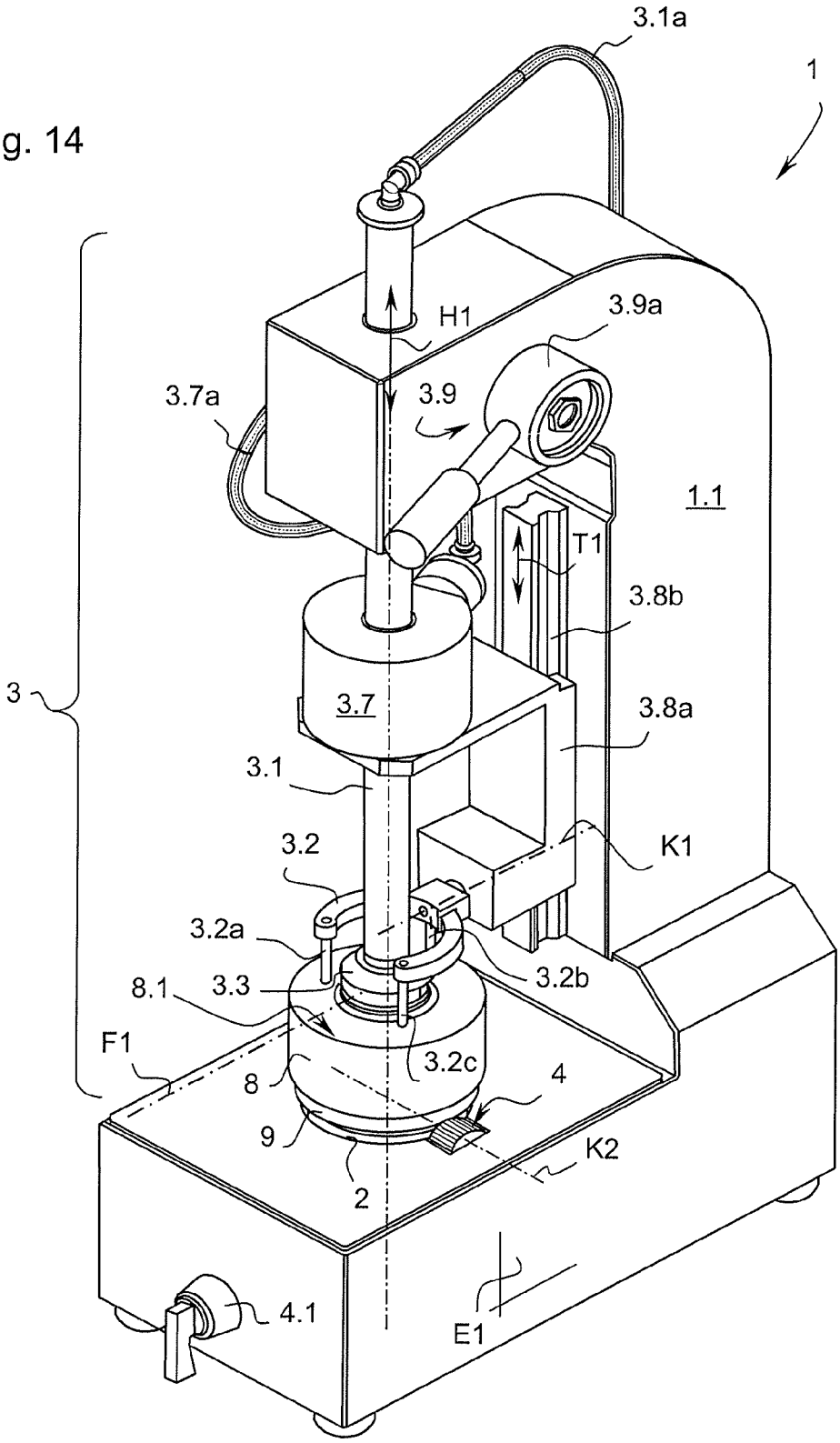
FIG. 14 is a perspective view of the blocking device according to a further version.

It be noted that the alterable end stop E can also be completely omitted if necessary. FIG. 14 shows this exemplary embodiment.

The embodiment according to FIG. 14 also shows that the pivot axes K1, K2 can also be arranged or implemented differently. Here, for example, the first tilting axis K1 is assigned to the alignment element 3.2 and the second tilting axis K2 which runs transversely to it is assigned to the blocking piece 9 or the blocking piece receiver 2. Therefore, here, the alignment element 3.2 can be tilted or pivoted around the tilting axis K1. The blocking piece 9 conversely can be tilted or pivoted only around the second tilting axis K2 here.

The suction cup 3.3 can alternatively or additionally be tilted or pivoted around an (imaginary) pivot axis F1. Therefore, in particular, different axis stackings are possible.

Figure 15:
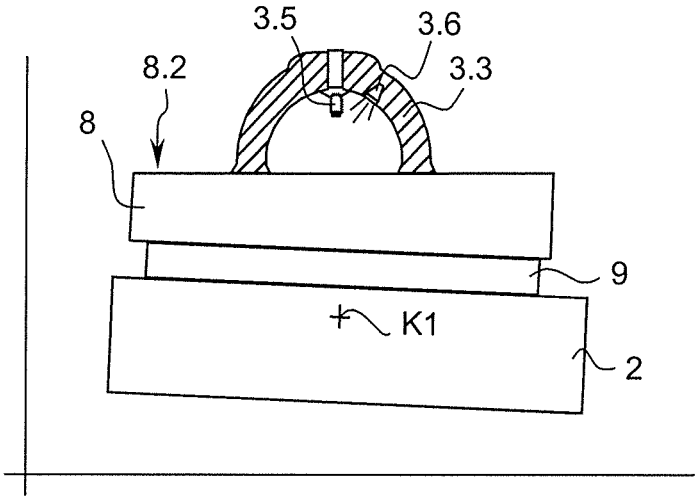
FIG. 15 is a schematic diagram for illustration of prismatic tilting.

FIG. 15 shows in a schematic how the pivot axis K1 can compensate for a prismatic tilting of the eyeglass lens 8 so that the suction cup 3.3 can be seated as free of tilting as possible on the top or reference side 8.2 of the eyeglass lens 8. By corresponding alignment of the eyeglass lens 8 or blocking piece 9 in the peripheral direction, prismatic tilting, whether tilting of the eyeglass lens 8 and/or of the blocking piece 9, can be aligned to the desired pivot axis K1. This is advantageous especially when there is only one single pivot axis K1. In particular, the axis of prismatic tilting will then be preferably aligned parallel to the tilting axis K1. Accordingly, if necessary, only one single tilting axis K1 is sufficient.

Individual aspects and features of the different embodiments can be combined with one another at will, but can also be implemented independently of one another.

What is claimed is:

1. A method for blocking of an eyeglass lens with one holding side onto one coupling side of a blocking piece by means of an adhesive, the blocking piece being held in a blocking piece receiver and the eyeglass lens being movable relative to the blocking piece along a lifting axis, comprising the steps of:

a) first, placing a holding side of an eyeglass lens on an adhesive-free coupling side of a blocking piece and positioning the holding side relative to the coupling side of the blocking piece;

b) aligning the eyeglass lens together with one of a blocking piece receiver and the blocking piece by a pivoting movement;

c) producing a fixed relative position of the eyeglass lens relative to the blocking piece with a positioning unit and using a locking means for preventing further pivoting movement;

d) raising the eyeglass lens in the fixed relative position using the positioning unit;

e) applying an adhesive to at least one the coupling side of the blocking piece and the holding side of the eyeglass lens; and f) using the positioning unit to cause the eyeglass lens in the fixed relative position to approach the blocking piece so as to move the holding side of the eyeglass lens into contact against the coupling side of the blocking piece so as to at least indirectly press the adhesive.

2. The method as claimed in claim 1, wherein said aligning step comprises moving the positioning unit or an alignment element against a reference side of the eyeglass lens in a direction of a lifting axis so as to align the eyeglass lens together with the blocking piece receiver by pivoting around at least one pivot axis.

3. The method as claimed in claim 1, wherein a stop is used to fix or define a position of the eyeglass lens with reference to the lifting axis when the eyeglass lens is fixed by the positioning unit in the fixed relative position; and wherein the stop is adjusted so that an altered position of the positioning unit is achieved in the direction of the lifting axis and an increased distance is achieved between the blocking piece receiver and the positioning unit in the direction of the lifting axis when the eyeglass lens is moved onto the blocking piece by means of the positioning unit and the adhesive is pressed until the altered position of the stop is reached.

4. The method as claimed in claims 1, wherein at least one of steps a), b), c), d), e) and f) is performed manually.

5. The method as claimed in claim 1, wherein the coupling side of the blocking piece is provided with markings and the eyeglass lens has eyeglass lens markings, and wherein the markings of the blocking piece and the eyeglass lens markings are aligned relative to one another for positioning of the eyeglass lens.

6. The method as claimed in claim 1, wherein at least one of the coupling side of the blocking piece and the holding side of the eyeglass lens is machined to be at least essentially complementary to each other with an accuracy of 0.5 mm or less.

7. A blocking device for blocking of eyeglass lenses on blocking pieces, comprising:

a blocking piece receiver which is located on a base body and to which an eyeglass lens is to be attached and a positioning unit which is located on the base body for alignment and holding of the eyeglass lens which is to be blocked, wherein the blocking piece receiver and the positioning unit are movable relative to one another in the direction of a lifting axis, wherein the relative movement between the positioning unit and the blocking piece receiver in the direction of the lifting axis is limitable by at least one adjustable stop in at least two positions, and wherein a coupling side of the blocking piece is essentially complementary to the holding side of a eyeglass lens with an accuracy of 0.5 mm or less.

8. The blocking device as claimed claim 7, wherein the stop is movable incrementally or continuously into several positions.

9. The blocking device as claimed in claim 7, wherein the stop has at least one stop surface which forms one end stop.

10. The blocking device as claimed in claim 7, wherein the stop is a stop plate which is adjustable transversely to the direction of the lifting axis and is provided with several staggered stop surfaces.

11. The blocking device as claimed in claim 7, wherein the stop is a stop nut which is adjustable in the direction of the lifting axis and has a stop surface or ramp which is adjustable transversely to the direction of the lifting axis.

12. The blocking device as claimed in claim 7, wherein the positioning unit has a holding element which forms an alignment element.

13. The blocking device as claimed in claim 12, wherein the holding element has a suction cup with an inner side connect to a source of negative pressure.

14. The blocking device as claimed in claim 13, further comprising an illumination unit on or in the suction cup.

15. The blocking device as claimed in claim 13, wherein the alignment element has two or three contact pins which act in the direction of the lifting axis and which are arranged circumferentially relative to at least one of the lifting axis and the suction cup, and which are positioned to be locatable against the eyeglass lens in the direction of the lifting axis.

16. The blocking device as claimed in claim 12, wherein the alignment element has an axis of translation which runs parallel to the lifting axis, a coupling device for coupling the alignment element and the holding element, wherein lifting movement of the alignment element along the lifting axis and movement of the holding element along the axis of translation are synchronized in a coupled state and wherein the translational movement of the holding element place in the direction of the axis of translation is producible independent the lifting motion of the alignment element in an uncoupled state.

17. The blocking device as claimed in claim 16, wherein at least one of the lifting movement and operation of the coupling device are manually producible.

18. The blocking device as claimed in claim 7, wherein the blocking piece receiver has two pivot axes which are aligned at right angles to one another and at a right angle to the lifting axis and about which the blocking piece receiver is freely manually pivotable, and the blocking piece receiver being fixable in a position to which it has been pivoted.

19. A blocking device for blocking of eyeglass lenses on blocking pieces, comprising:

a blocking piece receiver which is located on a base body and to which an eyeglass lens is to be attached and a positioning unit which is located on the base body for alignment and holding of the eyeglass lens which is to be blocked, wherein the blocking piece receiver and the positioning unit are movable relative to one another in the direction of a lifting axis, wherein the relative movement between the positioning unit and the blocking piece receiver in the direction of the lifting axis is limitable by at least one adjustable stop in at least two positions, and wherein the stop is movable incrementally or continuously into several positions.

20. The blocking device as claimed in claim 19, wherein the stop has at least one stop surface which forms one end stop.

21. The blocking device as claimed in claim 19, wherein the stop is a stop plate which is adjustable transversely to the direction of the lifting axis and is provided with several staggered stop surfaces.

22. The blocking device as claimed in claim 19, wherein the stop is a stop nut which is adjustable in the direction of the lifting axis and has a stop surface or ramp which is adjustable transversely to the direction of the lifting axis.

23. A blocking device for blocking of eyeglass lenses on blocking pieces, comprising:

a blocking piece receiver which is located on a base body and to which an eyeglass lens is to be attached and a positioning unit which is located on the base body for alignment and holding of the eyeglass lens which is to be blocked, wherein the blocking piece receiver and the positioning unit are movable relative to one another in the direction of a lifting axis, wherein the relative movement between the positioning unit and the blocking piece receiver in the direction of the lifting axis is limitable by at least one adjustable stop in at least two positions, and wherein the positioning unit has a holding element which forms an alignment element.

24. The blocking device as claimed in claim 23, wherein the holding element has a suction cup with an inner side connect to a source of negative pressure.

25. The blocking device as claimed in claim 24, further comprising an illumination unit on or in the suction cup.

26. The blocking device as claimed in claim 24, wherein the alignment element has two or three contact pins which act in the direction of the lifting axis and which are arranged circumferentially relative to at least one of the lifting axis and the suction cup, and which are positioned to be locatable against the eyeglass lens in the direction of the lifting axis.

27. The blocking device as claimed in claim 23, wherein the alignment element has an axis of translation which runs parallel to the lifting axis, a coupling device for coupling the alignment element and the holding element, wherein lifting movement of the alignment element along the lifting axis and movement of the holding element along the axis of translation are synchronized in a coupled state and wherein the translational movement of the holding element place in the direction of the axis of translation is producible independent the lifting motion of the alignment element in an uncoupled state.

28. The blocking device as claimed in claim 27, wherein at least one of the lifting movement and operation of the coupling device are manually producible.

29. A blocking device for blocking of eyeglass lenses on blocking pieces, comprising:

a blocking piece receiver which is located on a base body and to which an eyeglass lens is to be attached and a positioning unit which is located on the base body for alignment and holding of the eyeglass lens which is to be blocked, wherein the blocking piece receiver and the positioning unit are movable relative to one another in the direction of a lifting axis, wherein the relative movement between the positioning unit and the blocking piece receiver in the direction of the lifting axis is limitable by at least one adjustable stop in at least two positions, and wherein the blocking piece receiver has two pivot axes which are aligned at right angles to one another and at a right angle to the lifting axis and about which the blocking piece receiver is freely manually pivotable, and the blocking piece receiver being fixable in a position to which it has been pivoted.

* * * * *